US007509761B2

(12) United States Patent
Owusu-Atuahene

(10) Patent No.: US 7,509,761 B2
(45) Date of Patent: Mar. 31, 2009

(54) APPARATUS FOR USE IN A GAME OR A DISPLAY

(76) Inventor: Kwame Owusu-Atuahene, Bramley Corner, 7 Kinleside Way, Angmering, West Sussex (GB) BN16 4FE ( * ) Notice: Subject to any disclaimer, the term of this patent is extended or adjusted under 35 U.S.C. 154(b) by 0 days.

(21) Appl. No.: 10/570,727

(22) PCT Filed: Sep. 2, 2004

(86) PCT No.: PCT/GB2004/003762

§ 371 (c)(1),
(2), (4) Date: Oct. 17, 2006

(87) PCT Pub. No.: WO2005/024759

PCT Pub. Date: Mar. 17, 2005

(65) Prior Publication Data

US 2007/0062082 A1 Mar. 22, 2007

(30) Foreign Application Priority Data

Sep. 5, 2003 (GB) ..... 0320884.0

(51) Int. Cl.
*G09F 11/02* (2006.01)

(52) U.S. Cl. ..... 40/503; 40/506; 446/146; 446/242; 446/213; 472/61; 472/72

(58) Field of Classification Search ..... 40/503, 40/506; 446/146, 242, 213; 472/61, 72
See application file for complete search history.

(56) References Cited

U.S. PATENT DOCUMENTS 4,586,713 A * 5/1986 Abu-Shumays et al. .. 273/153 S
5,297,353 A 3/1994 Ghalayini
5,562,459 A * 10/1996 Durlach ..... 434/402

FOREIGN PATENT DOCUMENTS

GB 2 296 873 A 7/1996
WO WO-00/36579 A 6/2000
WO WO-03/038788 A1 5/2003

* cited by examiner

*Primary Examiner*—Paul N Dickson
*Assistant Examiner*—Shin Kim
(74) *Attorney, Agent, or Firm*—Lerner, David, Littenberg, Krumholz & Mentlik, LLP

(57) ABSTRACT

Apparatus for creating a number of display images comprises a first rotating element provided with a plurality of mounting means, each of said mounting means rotatably carrying one or more second rotating elements each provided with a number of display surfaces in which the mounting means are arranged such that they define a shape with substantially straight edges, and in which two or more second rotating elements can combine to create a changeable display surface substantially parallel to each substantially straight edge of said shape, and in which in use each second rotating element is rotated independently of all other second rotating elements.

29 Claims, 4 Drawing Sheets

APPARATUS FOR USE IN A GAME OR A DISPLAY

This invention relates to apparatus with a plurality of multi-rotating surfaces, for use particularly, but not exclusively in a game.

According to a first aspect of the present invention apparatus for creating a number of display images comprises a first rotating element provided with a plurality of mounting means, each of said mounting means rotatably carrying one or more second rotating elements each provided with a number of display surfaces, in which the mounting means are arranged such that they define a shape with substantially straight edges, and in which two or more second rotating elements can combine to create a changeable display surface substantially parallel to each substantially straight edge of said shape, and in which in use each second rotating element is rotated independently of all other second rotating elements.

It will be appreciated that the first rotating element can be any shape upon which the mounting means can be arranged to define a shape with substantially straight edges. For example, the first rotating element can be a shape comprising a number of pronged portions which extend from a centre portion and carry the mounting means at their outer ends. For example, if three mounting means are provided which define a triangle shape, the first rotating element can be shaped similar to a three-pointed star.

However, in a preferred construction the first rotating element can be provided with a number of substantially straight edges which are substantially parallel to the edges of the shape defined by the mounting means. In addition a changeable display surface created by two or more second rotating elements can be substantially level with each straight edge of the first rotating element.

In one construction the second rotating elements can rotatably carry a plurality of third rotating elements in the same manner as the first rotating element carries the second rotating elements. In such an arrangement the display surfaces are carried on the third rotating elements. It will be appreciated that the third rotating elements could carry fourth rotating elements, and the fourth rotating elements could carry fifth rotating elements and so on. However, in a preferred construction, only first and, second rotating elements are used.

In a preferred construction the first rotating element is mounted on a support member, which passes through its centre. The support member, each second rotating element, or the arrangement of the second rotating elements, can be adapted to prevent the support member fowling the second rotating elements in use.

In one construction the support member can be a rigid rod which passes through the apparatus, and which may be provided with a point at one end. With this arrangement the second rotating elements are dimensioned to avoid fowling the rod.

In use, the rod and apparatus can be spun like a spinning top, which will come to rest with one edge, or side, of the first rotating element lying flat on the spinning surface, and one or more other edges facing uppermost. As a result displays formed by the display surfaces of the second rotating elements are presented. In one construction the second rotating elements can rotate on their own axis when the apparatus is spun. Therefore, a multitude of different results can be gained from each spin, and therefore, the apparatus can be used in a game.

It will be appreciated that the apparatus can also be used without the rod, and could be thrown like a die, or simply manipulated by hand if desired.

In a second construction, a plurality of the above described apparatus can be used to create a display surface.

Therefore, according to a second aspect of the present invention, apparatus for a creating a number of display images comprises one or more support members and a number of display members rotatably carried thereon, in which each display member comprises a first rotating element provided with a plurality of mounting means, each of said mounting means rotatably carrying one or more second rotating elements each provided with a number of display surfaces, in which the mounting means are arranged such that they define a shape with substantially straight edges, and in which two or more second rotating elements can combine to create a changeable display surface substantially parallel to each substantially straight edge of said shape, in which in use each second rotating element is rotated independently of all other second rotating elements, and in which the display members can be disposed to collectively define a substantially flat display surface.

As in the first aspect of the present invention the first rotating element can be provided with a number of substantially flat edges which are substantially parallel to the edges of the shape defined by the mounting means. In addition a changeable display surface created by two or more second rotating elements can be substantially level with each flat edge.

In addition the second rotating elements can rotatably carry a plurality of third rotating elements in the same manner as the first rotating element. Again, the third rotating elements could carry fourth rotating elements, and the fourth rotating elements could carry fifth rotating elements and so on. However, in a preferred construction, only first and second rotating elements are used.

It will be appreciated that the apparatus can be used to create any display, and could be used to create a message board, a public information display or a changing advertising hoarding. However, in a preferred construction the apparatus is used for a game, pursuit or puzzle, and the display surfaces carry indicia and/or images for such a purpose.

In both the first and second aspects of the present invention, the first rotating element preferably comprises two substantially equilateral triangle shaped members disposed opposite one another, which are provided with an aperture through their centre, so they can be rotatably mounted to a support member.

With such an arrangement the mounting means can comprise rods extending from one member to the other.

The second rotating elements can comprise elongate members dimensioned to fit the two opposed first rotating element members, and which can have a substantially equilateral triangle shaped cross-section, and three display surfaces. The second rotating elements can be carried on the rods by means of co-operating apertures through their body.

In an alternative embodiment the first rotating elements can be spaced apart to allow two or more second rotating elements to be carried adjacent one another on each rod.

Any number of second rotating elements can be arranged to present a display surface parallel to each edge of the first rotating element, for example there could be three or four, or any other number in a row.

However, in a preferred construction two second rotating elements are disposed adjacent each edge of the first rotating element, and the length of the sides of the second rotating elements can be substantially half that of the sides of the first rotating elements. Further, each first rotating element can carry three second rotating elements, which can be mounted such that corners of the second rotating elements can be aligned with the adjacent corners of the first rotating element.

It will be appreciated that with this arrangement the support member passing through the first rotating element cannot be rigid, because the second rotating elements would not be able to fully rotate. Therefore, the one or more support members may comprise a number of parallel resilient cords.

A number of the first rotating elements can be mounted adjacent one another in a row on one cord, and the distance between each cord can be approximately equivalent to the length of one side of the first rotating elements.

With this arrangement, when the first rotating elements are all rotated such that one edge is uppermost, and all the second rotating elements are rotated such that one surface is parallel with the uppermost edge of their first rotating element, a substantially flat main gaming, pursuit or puzzle surface is defined.

It will be appreciated that in the arrangement as described above, each first rotating element presents two display surfaces on the main display surface. As each second rotating element can be rotated to display three different display surfaces, a total of nine combinations can be formed. Further, eighteen further combinations can be provided by the other two edges of the first rotating element. Therefore, each first rotating element can present 27 different indicia and/or image combinations to the main display surface.

In a preferred construction the cords are mounted to a frame, which defines the edge of the main display surface.

In one construction a three dimensional frame structure is provided, which defines a number of main display surfaces. Therefore a cube or a pyramid can be provided with main display surfaces on each surface.

It will be appreciated that the first and second rotating elements can be formed into other shapes than triangles, without departing from the spirit of the invention.

Further, the first and second rotating elements can be provided with light or sound emitting means which can be activated when one or more of either the first or the second rotating elements are orientated in a particular way. In addition, the first and second rotating elements can be motorized so that they can rotate themselves.

In one embodiment the first and second rotating elements can be provided with biasing means to resiliently bias the first and second rotating elements to rotational positions in which one edge is parallel to the main display surface.

Preferably the first rotating elements can be releasably mounted to the support members, such that they can be rearranged thereon if desired. This also allows an individual display member to be removed from an apparatus according to the second aspect of the present invention, and used in an apparatus according to the first aspect of the present invention.

In addition, the second rotating elements are preferably releasably mounted to the first rotating members, such that they can be rearranged thereon if desired.

The invention can be performed in various ways, but six embodiments will now be described by way of example and with reference to the accompanying drawings In which.

Figure 1:
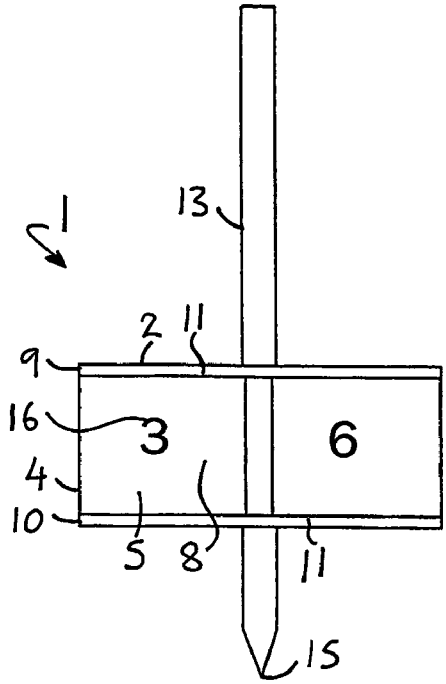
FIG. 1 is a side view of apparatus according to the first aspect of the present invention.
Figure 2:
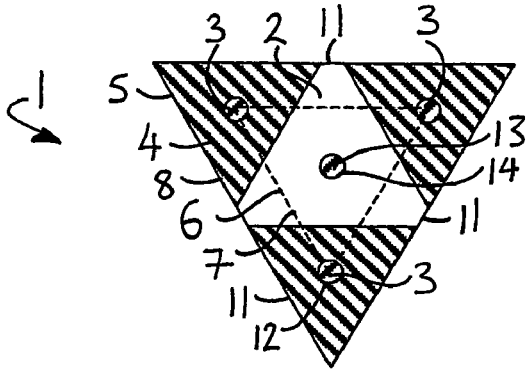
FIG. 2 is a cross-sectional top view of the apparatus as shown in FIG. 1 in a first arrangement.
Figure 3:
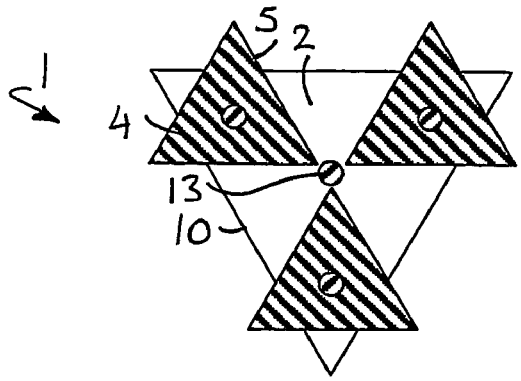
FIG. 3 is a cross-sectional top view of the apparatus as shown in FIG. 1 in a second arrangement.

In FIGS. 1-3 apparatus for presenting a number of display images 1 comprises a first rotating element 2 provided with a plurality of mounting means, in the form of rods 3, each of said rods 3 rotatably carrying one or more second rotating elements 4 each provided with a number of display surfaces 5, in which the rods 3 are arranged such that they define a shape, in the form of triangle 6, with straight edges 7, and in which two or more second rotating elements 4 can combine to create a changeable display surface 8 substantially parallel to each straight edge 7 of said triangle 6, and in which in use as described below, each second rotating element 4 is rotated independently of all other second rotating elements 4.

The first rotating element 2 comprises a first and a second opposing equilateral triangle shaped members 9 and 10, which each have three flat edges 11, which are parallel to the edges 7 of the triangle 6. The rods 3 extend between the first 9 and the second 10 members, and each rod 3 carries a second rotating element 4 by means of an aperture 12 which extends through the centre of each second rotating element 4. The second rotating elements 4 are freely rotatable on the rods 3. The edges 11 of the members 9 and 10 are level with the display surface 8.

A rigid support rod 13 extends through the centre of the apparatus 1, by means of apertures 14 in the first and second members 9 and 10. The support rod 13 is provided with a point 15 at one end.

The display surfaces 5 of the second rotating elements 4 are less than half the length of the edges 11 of the first rotating element members 9 and 10, such that the second rotating elements 4 do not contact the support rod 13 when they rotate, as shown clearly in FIG. 3.

Indicia in the form of numerals 16 are provided on the display surfaces 5.

In use the support rod 13 is placed substantially vertically on a spinning surface (not shown) and spun on the point 15. The first rotating element members 9 and 10 will therefore rotate in co-ordination with the support rod 13, and the second rotating elements 4 will rotate independently on their own axis during the rotation of the first rotating element members 9 and 10.

When the spin comes to an end, one edge 11 of the second first rotating element member 10 will rest on the spinning surface, and therefore, the other two edges 11 will be uppermost, and various numerals 16 will be presented. Therefore, the apparatus can be used to generate a variety of numeral combinations, which can be used in any game or like pursuit In FIGS. 4 and 5 apparatus for a creating a number of display images 20 comprises one or more support members, in the form of resilient cords 21 and a number of display members 22 rotatably carried thereon, in which each display member 22 comprises a first rotating element 23 provided with a plurality of mounting means, in the form of rods 24, each of said rods 24 rotatably carrying one or more second rotating elements 25 each provided with a number of display surfaces 26, in which the rods 24 are arranged such that they define a shape, in the form of triangle 27, with straight edges 28, and in which two or more second rotating elements 25 can combine to create a changeable display surface 29 substantially parallel to each straight edge 28 of said triangle 27, in which in use as described below, each second rotating element 25 is rotated independently of all other second rotating elements 25, and in which the display members 22 can be disposed to collectively define a substantially flat main display surface 30.

A frame 31 carries the cords 21, of which there are four, and each of which carries six display members 22.

The first rotating elements 23 comprise a first and a second opposing equilateral triangle shaped members 32 and 33, which each have three flat edges 34, which are parallel to the edges 28 of the triangle 27. The rods 24 extend between the first 32 and the second 33 members, and each rod 24 carries a second rotating element 25 by means of an aperture 35 which extends through the centre of each second rotating element 25. The second rotating elements 25 are independently freely rotatable on the rods 24. The edges 34 of the members 32 and 33 are level with the display surface 29.

Apertures 36 are provided in the first and second members 32 and 33, through which the cords 21 pass. Slots 37 are also provided, and the first and second members 32 and 33 can be resiliently deformed such that the display members 22 can be removed from the cords 21 by means of the slots 37. This allows for the display members 22 to be rearranged within the frame 31.

The display surfaces 26 of the second rotating elements 25 are half the length of the edges 34 of the first rotating element members 32 and 33, such that the second rotating elements 25 contact the cord 21 when they rotate. However, as the cord 21 is resilient, the second rotating elements 25 deform the cord 21 and rotate through a full 360 degrees.

The first and second rotating elements 23 and 25 are dimensioned to be manipulated by hand, or by any appropriate stylus instrument (not shown).

Figure 4:
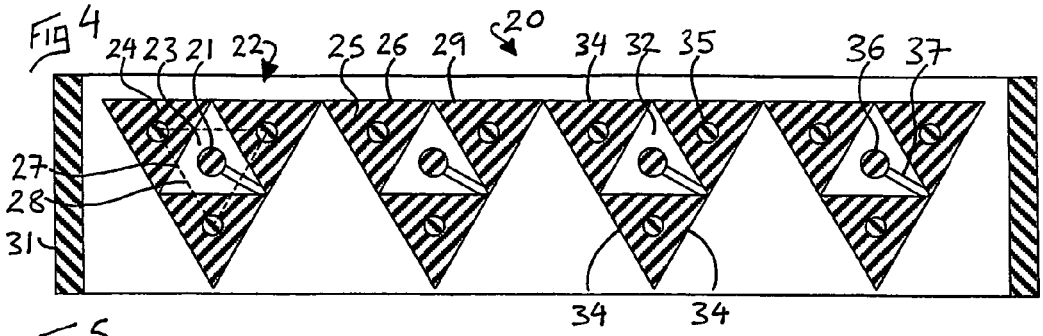
FIG. 4 is a cross-sectional side view of apparatus according to the second aspect of the present invention.
Figure 5:
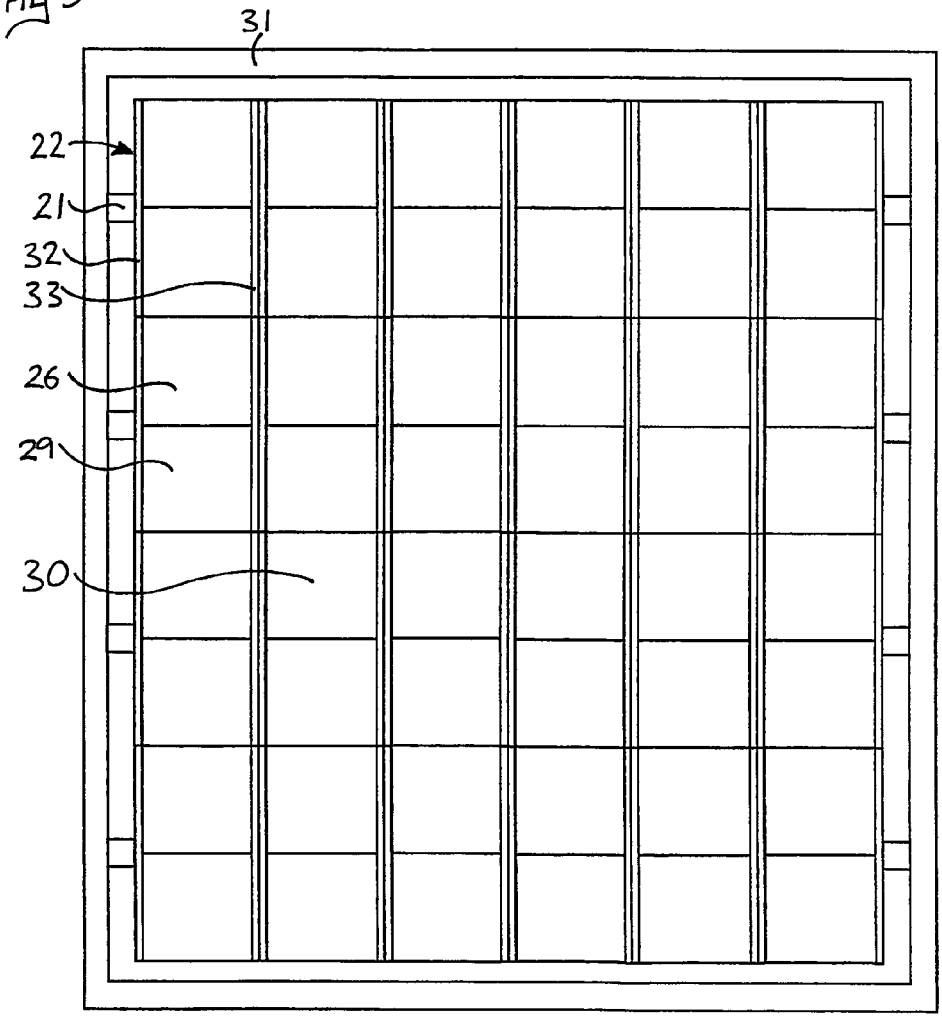
FIG. 5 is a top view of the apparatus as shown in FIG. 4.

It will be appreciated that as each of the twenty four first rotating elements 23 can display twenty seven different combinations of display surfaces 26, the apparatus in FIGS. 4 and 5, can display an extremely large number of variations. In addition, as the first rotating elements 23 can be rearranged on the cords 21, the possible number of variations is for all intents and purposes infinite.

In use the apparatus 20 can be used in several ways. In a first use the apparatus can be used as a puzzle game, in which a complete picture can be formed when all the first and second rotating elements 23 and 25 are arranged into one variation. (This requires the first rotating elements 23 to be in a correct formation on the cords 21, and therefore an alternative embodiment can be provided in which the display members 22 cannot be removed from the cords 21).

This puzzle game can be enhanced by there being a number of different complete pictures which can be formed. In theory twenty seven different complete pictures could be formed, although this would require the same surfaces to be used more than once. If each display surface is to be used only once, then four different complete pictures could be formed, with one unused "red herring" display surface 26 left over.

In an alternative use, each display surface could be a different colour, such that an image of the user's own creation could be made by arranging the colours into a pattern or shape. (To enhance this use an alternative embodiment could be provided with a much larger number of first rotating elements 23 and second rotating elements 25, which would allow greater versatility.)

In a further alternative use the display surfaces can carry letters, such that words can be formed across the surface 30. Alternatively, the display surfaces 26 can carry words, such that sentences can be formed across the surface 30.

In one further alternative use the surface 30 can carry images upon which other games can be played, for example board games.

It will be appreciated that the above described alternative uses for the gaming surface can be used in any combination, and as the display members 22 can be removed a large number of alternative uses can be made available.

In one alternative embodiment (not shown) the cords 21, rods 24 and apertures 35 and 36 can be adapted to resiliently hold the first and second rotating elements 23 and 25 at a rotation at which one edge is parallel with the gaming surface 30. This would prevent the first and second rotating elements 23 and 25 freely rotating and disrupting a game, pursuit or puzzle in progress.

It will be appreciated that the apparatus 1 and 20 can be changed without departing from the definition of the Statement of Invention. In particular, apparatus can be provided with the various different features and arrangements as shown in FIGS. 6 to 9 and as described below, or with any possible combination of these features.

Figure 6:
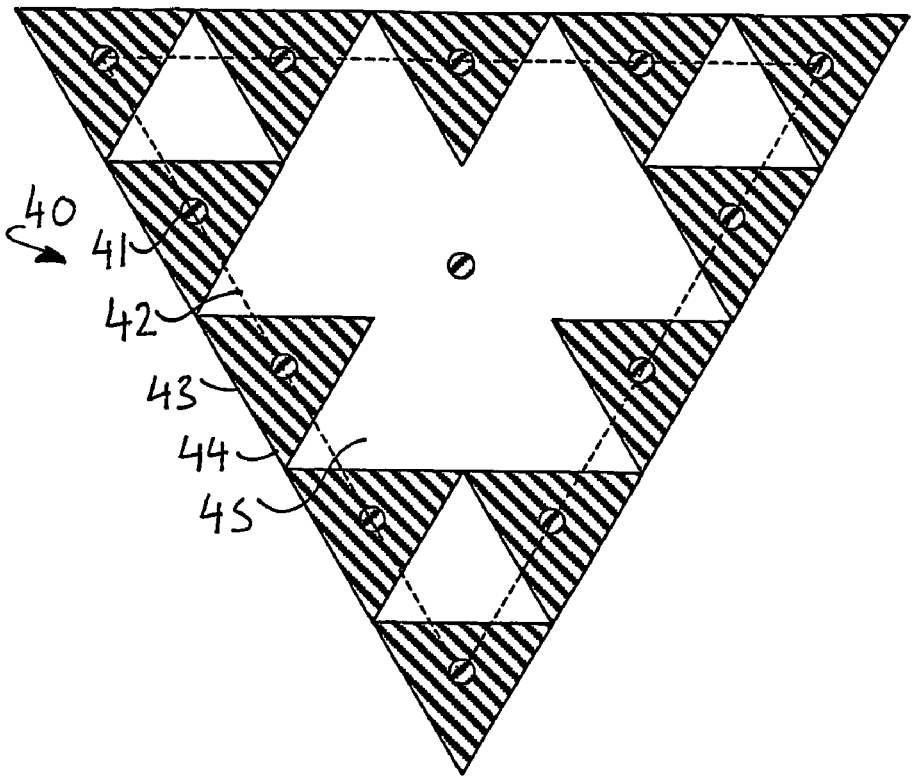
FIG. 6 is a cross-sectional top view of a second apparatus according to the first aspect of the present invention.

FIG. 6 shows apparatus 40 according to the first aspect of the present invention, or a display member as used in apparatus according to the second aspect of the present invention, similar to those described above, but in which more than three mounting rods 41 are arranged into a triangle shape 42. With this arrangement more than two second rotating elements 43 are provided along each edge 44 of a first rotating element 45.

Figure 7:
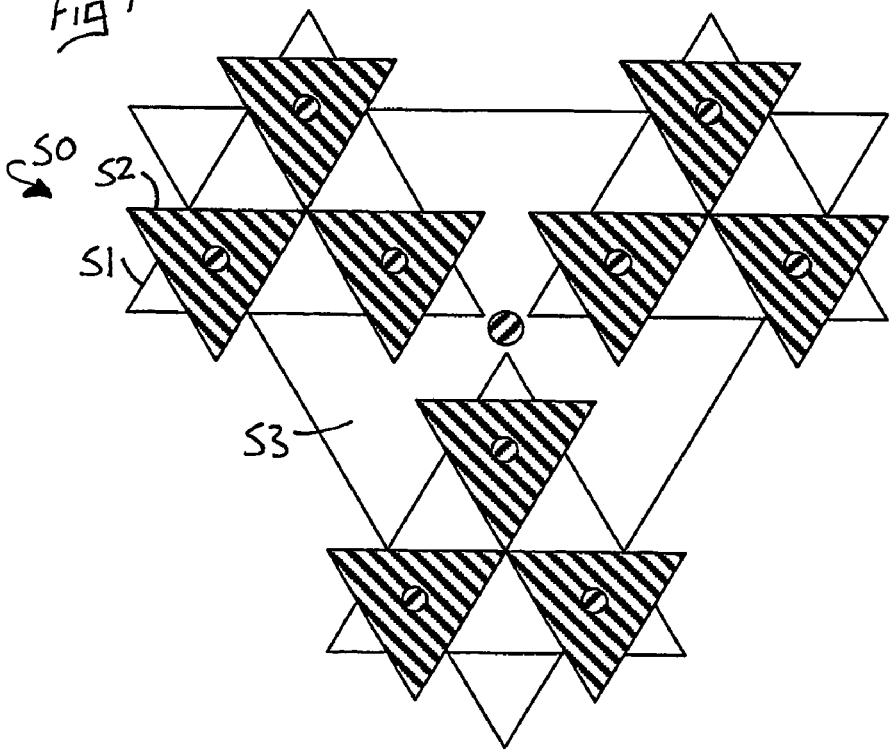
FIG. 7 is a cross-sectional top view of a third apparatus according to the first aspect of the present invention.

FIG. 7 shows apparatus 50 according to the first aspect of the present invention, or a display member as used in apparatus according to the second aspect of the present invention, similar to those described above, but in which second rotating elements 51 rotatably carry third rotating elements 52, in a similar manner to that in which the first rotating element 53 carries the second rotating elements 51. It will be appreciated that the third rotating elements 52 could carry fourth rotating elements, and the fourth rotating elements could carry fifth rotating elements and so on.

FIG. 7 also shows an arrangement in which the second rotating elements 51 are carried on the first rotating element 53 on mounting means in the form of bosses (not shown), which eliminates the need for a rod to pass through the second rotating element 51.

In one alternative embodiment (not shown) any of the second or third rotating elements described above can be removed from the first or second rotating elements described above and rearranged thereon to provide even greater flexibility.

Figure 8:
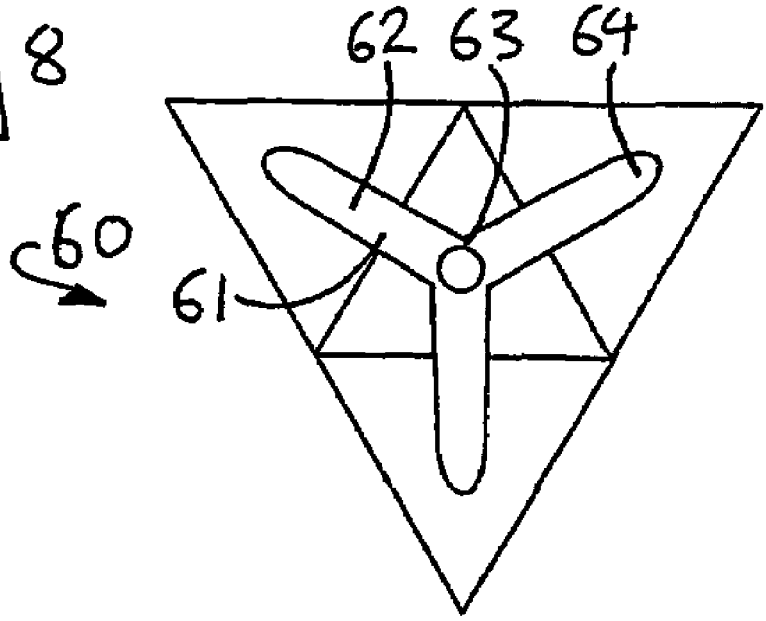
FIG. 8 is an end view of a fourth apparatus according to the first aspect of the present invention; and, FIG. 9 is a side view of the apparatus as shown in FIG. 8.
Figure 9:
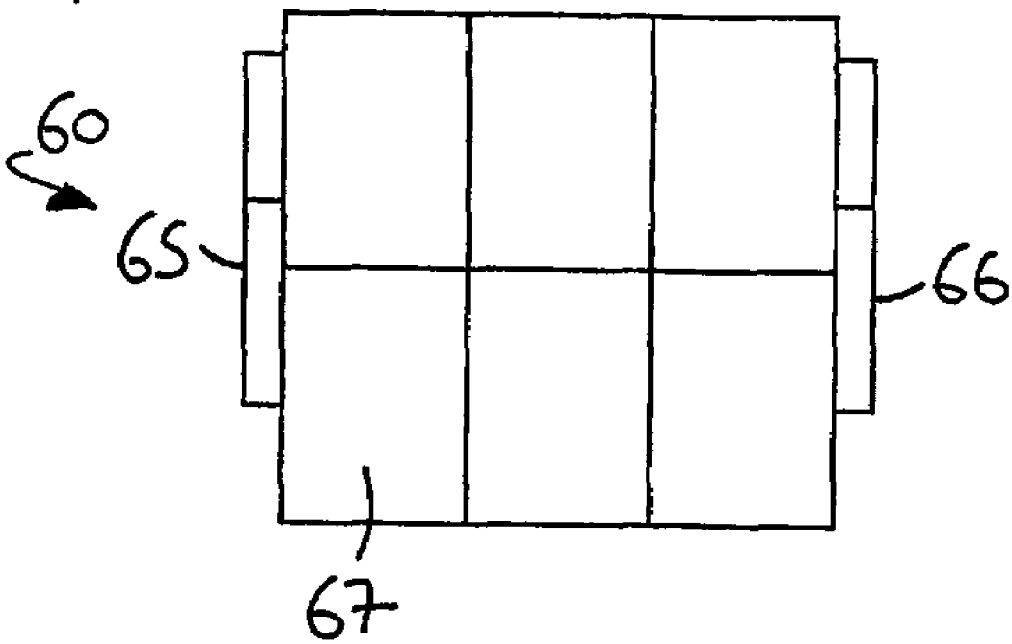

FIGS. 8 and 9 show apparatus 60 according to the first aspect of the present invention, or a display member as used in apparatus according to the second aspect of the present invention, similar to those described above, but in which the first rotating element 61 is not provided with straight edges which are parallel to the edges of the shape defined by the rods (not visible). Rather, the first rotating element is formed in a three-pointed star shape with three pronged portions 62 which extend from a centre portion 63 and carry the rods (not visible) adjacent their outer ends 64.

In addition, the first rotating element 61 comprises two members 65 and 66, which are spaced apart to allow a number of second rotating elements 67 to be carried adjacent one another on each rod (not visible). Apparatus 60 has three second rotating elements 67 carried on each rod, but it will be appreciated that this can be any number.

In another alternative embodiment (not shown) the first and second rotating elements are provided with light or sound emitting means which can be activated when one or more of either the first or the second rotating elements are orientated in a particular way. The technology to perform such functions is well known.

In one other alternative embodiment (not shown), the first and second rotating elements can be motorized so that they can be mechanically rotated, and a control means can be provided to control this rotation. With such an arrangement the apparatus 20 could be used as a changeable message board, a public information display or an advertising hoarding or the like.

In yet another alternative embodiment (not shown) a three dimensional frame structure is provided, each flat side of which comprises a frame similar to frame 31 in FIG. 5. Therefore a cube or a pyramid can be provided with main display surfaces on each surface.

Thus novel apparatus for presenting a number of display images, and apparatus which carries such apparatus is provided, which can be used to perform a number of games, puzzles or pursuits, or to create a number of different displays.

The invention claimed is:

1. Apparatus for creating a number of display images comprises a first rotating element provided with a plurality of mounting means, each of said mounting means rotatably carrying one or more second rotating elements each provided with a number of display surfaces, in which the mounting means are arranged such that they define a shape with substantially straight edges, and in which two or more second rotating elements can combine to create a changeable display surface substantially parallel to each substantially straight edge of said shape, and in which each second rotating element is rotatable independently of all the other second rotating elements.

2. Apparatus for creating a number of display images comprises one or more support members and a number of display members rotatably carried thereon, in which each display member comprises a first rotating element having at least two sides and provided with a plurality of mounting means, each of said mounting means rotatably carrying one or more second rotating elements, each having at least two sides and provided with a number of display surfaces, in which the mounting means are arranged such that they define a shape with substantially straight edges, and in which two or more second rotating elements can combine to create a changeable display surface substantially parallel to each substantially straight edge of said shape, in which in use each second rotating element is rotated independently of all other second rotating elements, and in which the display members can be disposed to collectively define a substantially flat main display surface.

3. Apparatus according to claims 1 or 2, in which the first rotating element is provided with a number of substantially straight edges which are substantially parallel to the edges of the shape defined by the mounting means, and in which a changeable display surface created by two or more second rotating elements is provided substantially level with each of said number of substantially straight edges.

4. Apparatus as claimed in claim 3 in which the first rotating element comprises two spaced apart and substantially equilateral triangle shaped members disposed opposite one another, which are each provided with an aperture through their centre, so they can be rotatably mounted to a support member.

5. Apparatus as claimed in claim 4 in which the second rotating elements comprise elongate members dimensioned to fit between the two first rotating element members, in which the second rotating elements have a substantially equilateral triangle shaped cross-section and three display surfaces.

6. Apparatus as claimed in claim 5 in which the first rotating element carries three second rotating elements, in which two second rotating elements can combine to create a changeable display surface substantially level with each of said number of substantially straight edges.

7. Apparatus as claimed in claim 6 in which the mounting means comprise rods extending from one first rotating element member to the other, and in which the second rotating elements are carried on the mounting means by means of co-operating apertures through their body.

8. Apparatus as claimed in claim 7 in which two or more second rotating elements are carried on each mounting means.

9. Apparatus as claimed in claim 6 in which the mounting means comprise bosses provided on one/or both of the first rotating element members, which are adapted to attach to the sides of the second rotating elements.

10. Apparatus as in any of claims 2 or 4-9, in which the one or more support members comprises one or more resilient cords.

11. Apparatus as claimed in claim 10 in which the length of the sides of the second rotating elements are substantially half the length of the sides of the first rotating element, and in which the resilient cords are adapted not to foul the second rotating elements in use.

12. Apparatus as claimed in claim 11 in which a number of resilient cords are mounted to a frame, which frame defines the edge of the main display surface.

13. Apparatus as claimed in claim 12 in which the distance between each resilient cord is substantially the length of one side of the first rotating element.

14. Apparatus as claimed in claim 10 in which the first rotating elements are releasably mounted to the support members, such that they can be re-arranged thereon as desired.

15. previously presented) Apparatus as claimed in any of claims 2, 4-9, or 11-14, in which the second rotating elements are releasably mounted to the first rotating elements, such that they can be re-arranged thereon as desired.

16. Apparatus as claimed in any of claims 2, 4-9, or 11-14, in which the display surfaces carry indicia and/or images for use in a game, pursuit or puzzle.

17. Apparatus as claimed in claim 16 in which the apparatus is a puzzle, and a complete picture can be formed on the main display surface when the first and second rotating elements are arranged into one variation.

18. Apparatus as claimed in claim 16 in which the apparatus is for a creative pursuit, and in which the display surfaces are different colours such that an image of the user's own creation can be formed on the main display surface by arranging the first and second rotating elements as desired.

19. Apparatus as claimed in claim 16 in which the display surfaces carry letters, such that words can be formed across the main display surface.

20. Apparatus as claimed in claim 16 in which the display surfaces carry words, such that sentences can be formed across the main display surface.

21. Apparatus as claimed in claim 16 in which the main display surface can carry one or more images upon which other games can be played, and in which the first and second rotating elements must be arranged into one or more predetermined variations to complete said images.

22. Apparatus as claimed in claim 16, in which the first or the second rotating elements are provided with biasing means to resiliently bias the first or the second rotating elements to rotational positions in which one edge is parallel to the main display surface.

23. Apparatus as claimed in any of claims 2, 4-9, 11-14, or 17-22, in which a three dimensional frame structure is provided which defines a number of main display surfaces.

24. Apparatus according to claims 1 or 2 in which the first rotating element is a shape comprising a number of pronged portions which extend from a centre portion, and in which the number of pronged portions carry the mounting means at their outer ends.

25. Apparatus as claimed in claim 1 in which the first rotating element is mounted on a support member, which passes through its centre, and in which the support member or each second rotating element or the arrangement of the second rotating elements, are adapted to prevent the support member fouling the second rotating elements in use.

26. Apparatus as claimed in claim 25 in which the support member is a rigid rod provided with a point at one end, and in which the second rotating elements are dimensioned to avoid fouling the rod in use, and in which when the rod is spun on its point, the second rotating elements are adapted to rotate on the mounting means.

27. Apparatus as in any of claims 1-2, or 4, in which the second rotating elements comprise a base provided with a plurality of mounting means, each of said mounting means rotatably carrying one or more third rotating elements each provided with a number of display surfaces, in which the mounting means are arranged such that they define a shape with substantially straight edges, and in which two or more third rotating elements can combine to create a changeable display surface substantially parallel to each substantially straight edge of said shape.

28. Apparatus as in any of claims 1-2, 4-9, 11-14, 17-22, or 25-26, in which the first or the second rotating elements are provided with light or sound emitting means which are activated when said first or second rotating elements are orientated in a particular way.

29. Apparatus as in any of claims 1-2, 4-9, 11-14, 17-22, or 25-26, in which the first and second rotating elements are motorised so that they can rotate themselves.

* * * * *